United States Patent [19]

Lozio

[11] 4,367,834

[45] Jan. 11, 1983

[54] TAG-ATTACHING GUN

[75] Inventor: Battista Lozio, Campione d'Italia, Italy

[73] Assignee: Battista Lozio & Figli S.P.A., Milan, Italy

[21] Appl. No.: 236,153

[22] Filed: Feb. 20, 1981

[30] Foreign Application Priority Data

Apr. 4, 1980 [IT] Italy ..... 21195 A/80

[51] Int. Cl.[3] ..... B25C 1/00

[52] U.S. Cl. ..... 227/67

[58] Field of Search ..... 227/67

[56] References Cited

U.S. PATENT DOCUMENTS 3,652,004 3/1972 Lozio ..... 227/67

3,924,788 12/1975 Furutu ..... 227/67

*Primary Examiner*—Mark Rosenbaum

*Assistant Examiner*—Timothy V. Eley

*Attorney, Agent, or Firm*—Karl F. Ross

[57] ABSTRACT

A gun for attaching tags of bar-lock type to a fabric has a body forming a barrel for the guidance of a plunger in line with a longitudinally slotted needle which is removably inserted into the front end of that body. A trigger articulated to the body is connected with the rear end of the plunger via a spring-loaded articulated linkage guided in an arcuate channel; the plunger has a head laterally inserted into a seat on an adjoining member of that linkage and can be laterally extracted from the barrel, e.g. for replacement upon an exchange of needles, after removal of a side cover and a grooved guide block adjacent thereto.

10 Claims, 21 Drawing Figures

Fig. 6
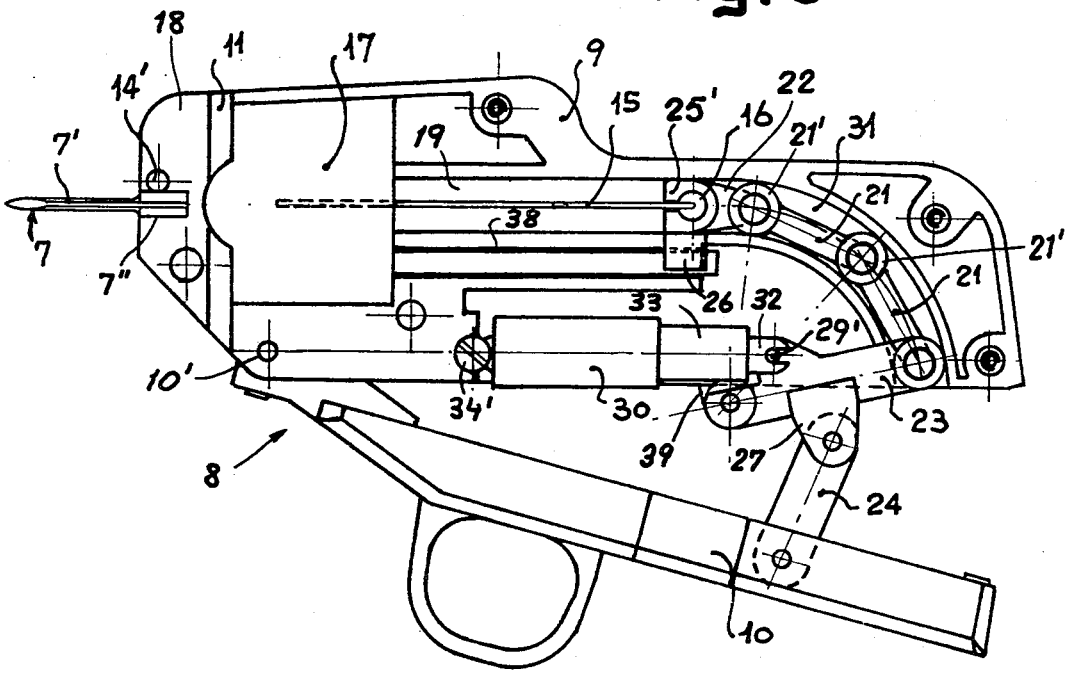
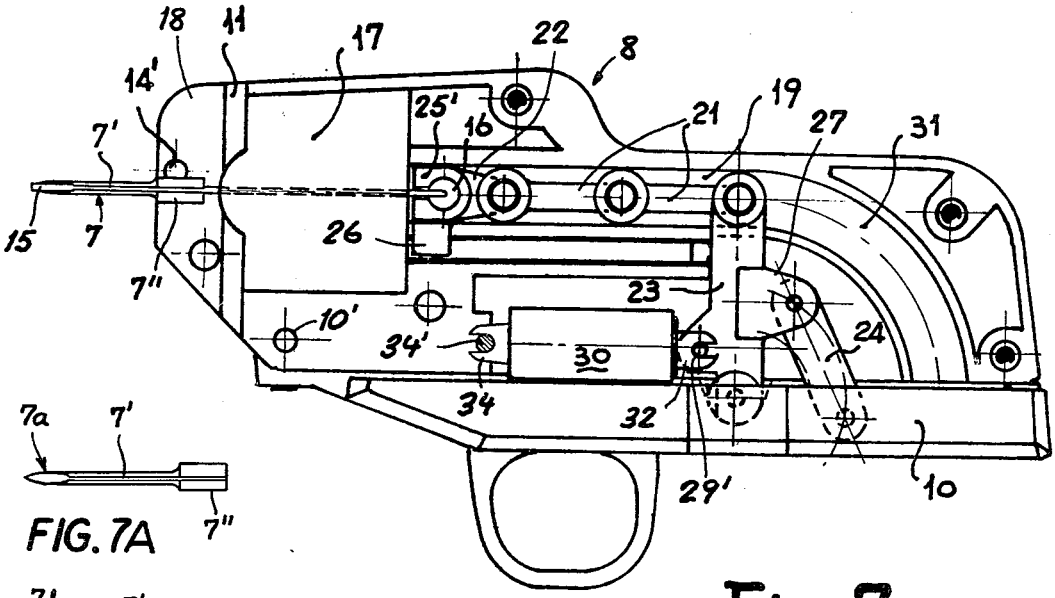
Fig. 7
FIG. 7A
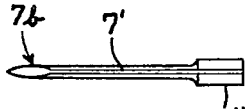
FIG. 7B

TAG-ATTACHING GUN

FIELD OF THE INVENTION

My present invention relates to a device, referred to hereinafter as a gun, designed for attaching tags of the bar-lock type to a penetrable article such as a fabric.

BACKGROUND OF THE INVENTION

Such a tag-attaching gun is known, for example, from U.S. Pat. No. 3,103,666 in the name of Arnold R. Bone. According to that patent, a longitudinally slotted needle is projectingly secured to the front end of the body of the device, a plunger slidable in that body being connected by a flexible link with a pivoted handle or trigger. The plunger has a stem whose tip, when the trigger is pressed, advances in the needle slot to dislodge the cross-bar of a tag previously inserted therein; the bar then comes to lie against the remote side of a fabric penetrated by the needle while the remaining part of the tag stays on the side confronting the gun. This part generally comprises a length of wire or other flexible filament passing through a label and terminating in an enlargement which prevents any unauthorized detachment of the label.

In my Italian Pat. No. 886,724, corresponding to my prior U.S. Pat. No. 3,652,004 I have disclosed an improved mechanism for feeding the tags to the slotted needle by means of a cam operatively coupled with the trigger.

When such a gun is to be used with a variety of fabric layers or the like differing in thickness or pore size, the needle used in each instance should have a length and a diameter adapted to the specific purpose. Thus, a longer and heavier needle will generally be required in the tagging of a carpet, for example, than would be the case with a shirt or similar garment. A change in the needle shape will usually also require the use of different plunger.

OBJECT OF THE INVENTION

The object of my present invention, therefore, is to provide an improved tag-attaching gun of the general type referred to which has means for facilitating the removal of its needle and its plunger for purposes of replacement, inspection or repair.

SUMMARY OF THE INVENTION

In accordance with my present invention, the barrel of the gun is open to one side and its plunger is laterally detachable from the coupling means normally connecting the plunger with the trigger, the gun body being provided with detachable cover means normally overlying the barrel at its open side and enabling by the removal thereof a lateral extraction of the plunger from the barrel in the idle position of the trigger. The needle is removably seated in the front end of the body where it is held in position by retaining means such as a locking pin.

Pursuant to a more particular feature of my invention, the cover means may include a block with a groove for the guidance of the plunger stem and a lid adjoining the block in a region of displacement of a plunger head engaged with the coupling means.

According to another feature of my invention, the coupling means connecting the plunger with the trigger comprises an articulated linkage with a plurality of members occupying an arcuate channel in the gun body, which merges tangentially into the rear end of the barrel, when the trigger is in its idle position. Advantageously, the trigger is biased into this idle position by spring means anchored to the body and the linkage, specifically to a rear member thereof.

BRIEF DESCRIPTION OF THE DRAWING

The above and other features of my invention will now be described in detail with reference to the accompanying drawing in which:

FIG. 6 is an elevational view of the body of the gun, as seen on the line VI—VI of FIG. 5, with a side covering removed and with its trigger in the idle position of FIG. 4;

FIG. 7 is a view similar to that of FIG. 6 but showing the gun in its working position, i.e. with its trigger depressed;

FIGS. 7A and 7B are side views of different needles usable with the gun of FIGS. 4–7;

SPECIFIC DESCRIPTION

Figure 1:
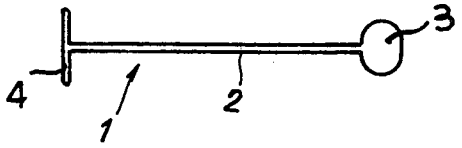
PRIOR ART Fig. 1
FIG. 1 is a plan view of a bar-lock tag to be attached to a fabric or the like by a gun embodying my invention.
Figure 2:
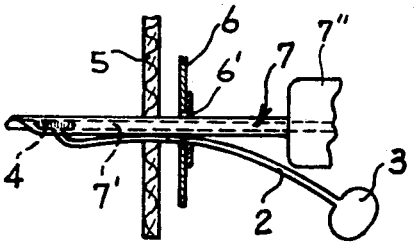
FIG. 2 shows the tag of FIG. 1 partly inserted into a needle penetrating a fabric.
Figure 3:
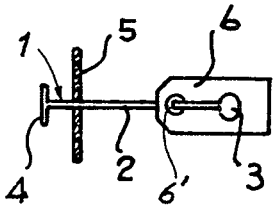
FIG. 3 is a plan view of the tag attached to the fabric.
Figure 4:
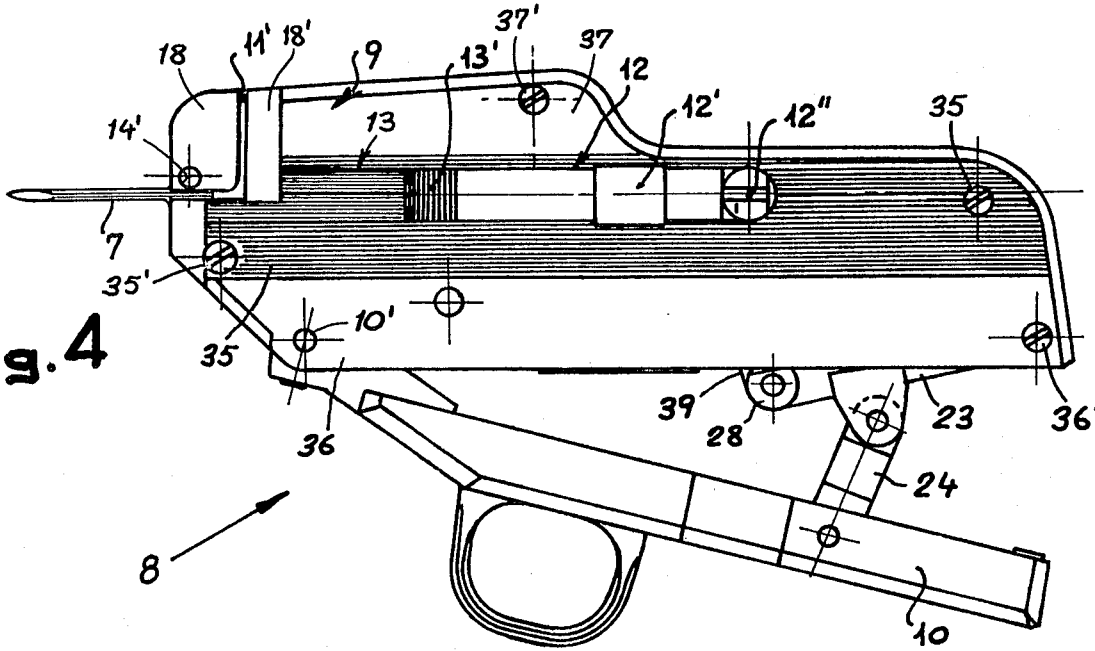
FIG. 4 is a side-elevational view of a tag-attaching gun according to my invention, with a trigger in an idle position.
Figure 5:
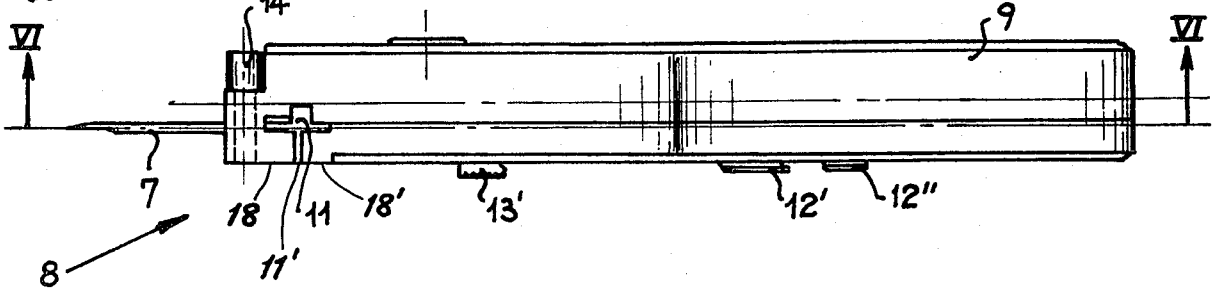
FIG. 5 is a top view of the gun shown in FIG. 4.

In FIGS. 1–3 I have shown a conventional bar-lock tag 1 to be attached to a fabric 5 (FIGS. 2 and 3) by the gun described hereinafter with reference to FIGS. 4–19. The tag 1 comprises a flexible filament 2 which terminates at one end in an enlarged head 3 and at the other end in a cross-bar 4 integral therewith. A label 6, to be tied to the fabric 5 with the aid of tag 1, has an eye 6' with the hole through which the filament 2 can pass when the bar 4 is flexed into a position nearly parallel to the filament; the enlarged head 3, however, cannot clear the hole. An insertion needle 7, FIG. 2, has a longitudinal slot 7' in which the bar 4 is slidably guided while the filament 2 extends outward through the side of the slot so as to lie close to the needle body; the latter terminates in an enlarged shank 7'' receivable in the front end of the gun. After the needle 7 accompanied by filament 2 has penetrated the eye 6' and the fabric 5, a plunger in the gun barrel is inserted from the direction of shank 7'' into the needle slot 7' to expel the bar 4 which promptly assumes its normal position transverse to the filament to lock the tag 1 to the fabric 5 as seen in FIG. 3.

As will be readily apparent, the bar 4 could be initially inserted into the needle slot 7' either from the pointed end of the needle (at left in FIG. 2) or through its shank 7'', provided of course that the shank is laterally slitted to accommodate the filament 2 as the tag is fed from an assembly of such tags inside the gun toward its attachment position in the manner described in the above identified Bone patent.

FIGS. 4–7 show a gun 8 with a body 9 forming a barrel 19 in which a plunger 20 (see FIGS. 12 and 13) is longitudinally slidable, this plunger having a stem 15 and a head 16. Stem 15 is in line with a needle 7 whose shank 7'' is seated in a front part 18 of body 9. The shank is held in position by a locking pin 14 frictionally engaging that shank upon insertion into a transverse bore 14' of the seat-forming part 18. Behind that part, and separated from it by a vertical channel 11 for the insertion of a tag assembly, a block 17 holds the means for detaching a tag, aligning it with needle slot 7' and advancing its cross-bar toward the tip of the needle in conformity with the disclosure of the Bone patent. Block 17 has a passage in line with barrel 19 for allowing the plunger stem 15 to enter the slot 7' in order to eject the bar of a tag so positioned. Such an advance is controlled, in a manner described hereinafter, by a trigger 10 which is pivoted at 10' to the gun body 9.

Figure 8:
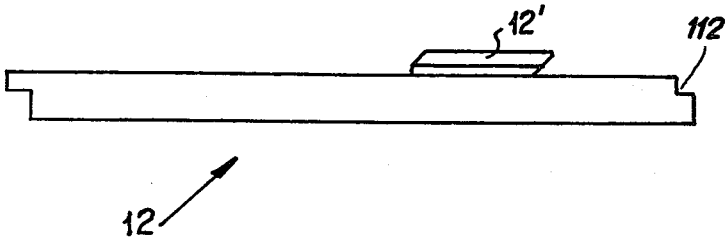
FIGS. 8 and 9 are, respectively, a bottom view and a side view of a barrel lid forming part of the covering omitted in FIGS. 6 and 7.
Figure 9:
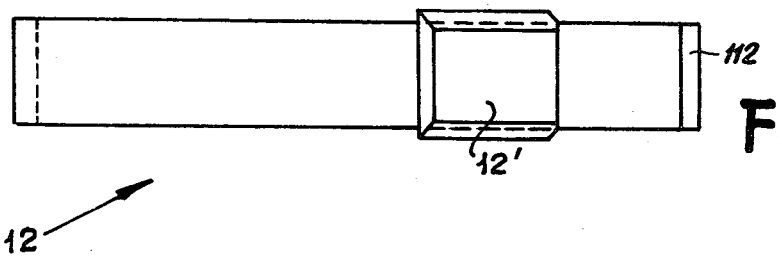
Figure 11:
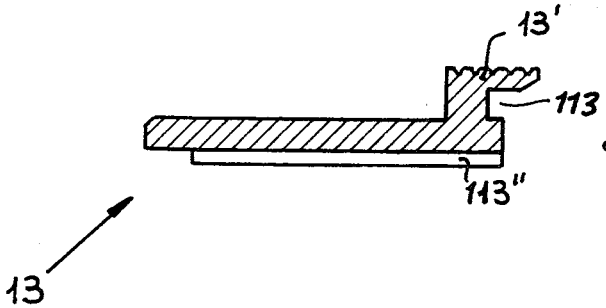
FIG. 11 is a cross-sectional view taken on the line XI—XI of FIG. 10.
Figure 10:
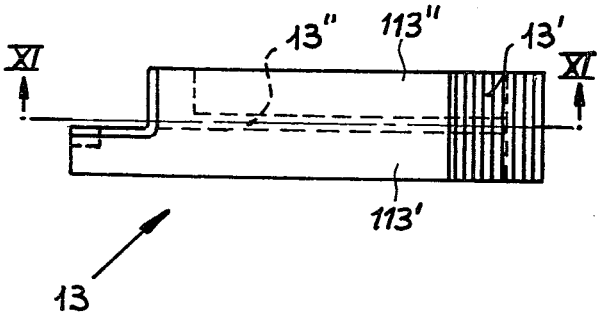
FIG. 10 is a side view of a guide block also forming part of the covering.
Figure 12:
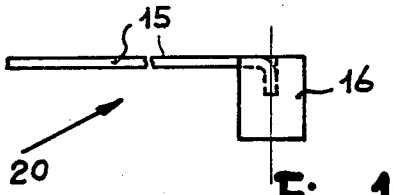
FIG. 12 is a bottom view and FIG. 13 is a side view of a plunger included in the gun of FIGS. 4–7.

Barrel 19 is laterally open, as seen in FIGS. 6 and 7, but is normally hidden from view by a lid 12 and a guide block 13 (FIG. 4) which are part of a covering also including side plates 35, 36, 37 held in position by screws 35', 36', 37'. Lid 12, shown more clearly in FIGS. 8 and 9, is provided with a gripping knob 12' and has a rabbeted right-hand end 112 engageable by a retaining screw 12''. Its left-hand end fits into an undercut 113 of block 13, best seen in FIGS. 10 and 11, which also has a gripping knob 13' and which is formed with inwardly projecting lower and upper cheeks 113', 113'' defining between them a groove 13'' for the guidance of stem 15. When mounted on gun body 9, block 13 is partly overhung by a strip 18' which is separated from part 18 by a slit 11' constituting an extension of channel 11. Thus, members 12 and 13 can be readily detached from body 9 upon removal of screw 12''.

At its rear end, barrel 19 merges tangentially into an arcuate channel 31 extending over approximately 90°. An articulated linkage, connecting trigger 10 with plunger 20, comprises a front member 22, two intermediate members 21 and a rear member 23, also guided in channel 31, as well as an outside member 24.

Figure 14:
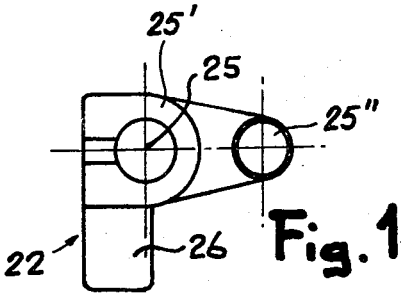
FIGS. 14 and 15 are, respectively, a side view and a top view of a front member of an articulated linkage connecting the plunger of FIGS. 12 and 13 with the trigger of the gun shown in FIGS. 4–7.
Figure 13:
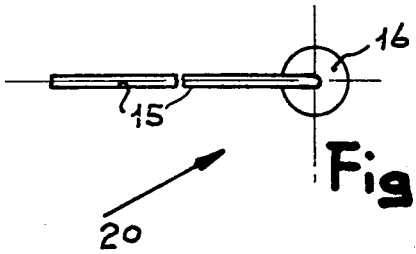
Figure 15:
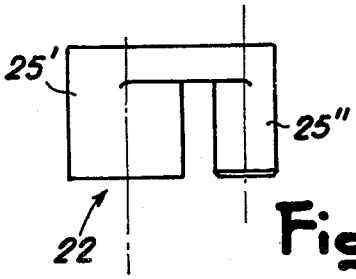
Figure 17:
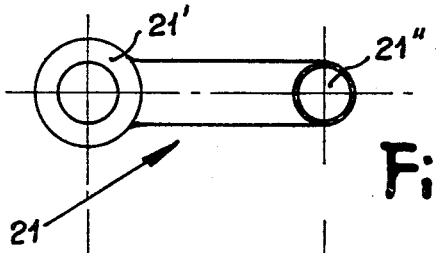
FIG. 16 is a top view (parts broken away) and FIG. 17 is a side view of an intermediate member of the articulated linkage.
Figure 16:
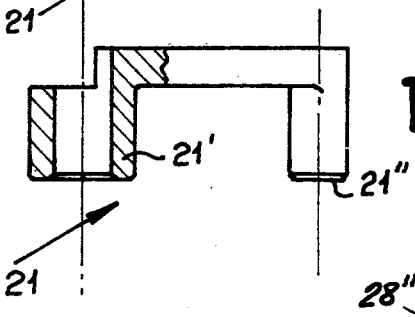
Figure 18:
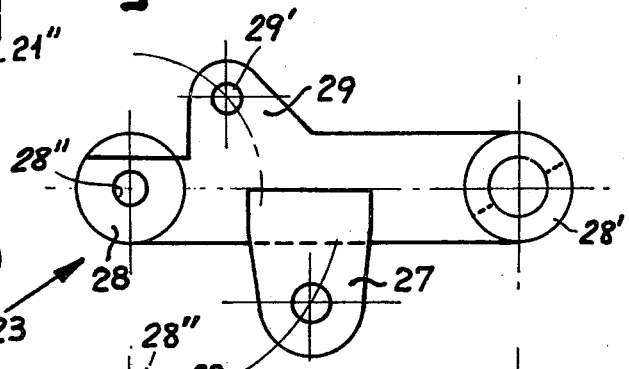
FIGS. 18 and 19 are, respectively, a side view and a top view of a rear member of the linkage.
Figure 19:
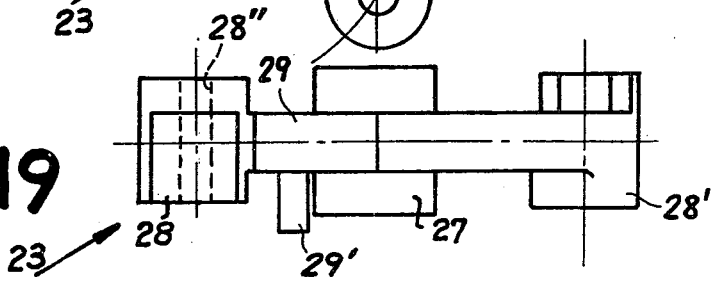

Front member 22, best shown in FIGS. 14 and 15, has a male end 25'' and a female end 25', the latter being provided with a bore 25 accommodating the head 16 of plunger 20; a stud 26 depends from its end 25' and is slidable along a ledge 38 at the lower boundary of barrel 19 to help stabilize the position of the linkage. Each intermediate member 21, best shown in FIGS. 16 and 17, similarly has a female end 21' and a male end 21'' enabling its pivotal joinder to adjacent members. Rear member 23, best seen in FIGS. 18 and 19, has a female end 28' engageable by the male end 21'' of the adjoining intermediate member 21. The opposite end of member 23 has an eye 28 with a bore 28'' by which it is fulcrumed to a lug 39 of body 9 (partly shown in FIGS. 4 and 6) at the center of curvature of channel 31. A hump 29 of member 23 carries a pin 29' engageable by a bifurcated extremity 32 of a compression spring comprising two telescoped elements 30 and 33 (see FIGS. 6 and 7), an opposite bifurcated extremity 34 straddling the shank of a screw 34' threaded into body 9. A lug 27 of member 23 is articulated to link 24 which in turn is swivelably mounted on trigger 10.

The female ends 21' and 28' of link members 21 and 23 have diameters only slightly smaller than the width of channel 31 so as to be slidably received in that channel in the idle position of the gun, see FIG. 6, into which the trigger 10 is biased by the pressure of spring 30, 32–34 acting upon hump 29 of member 23. The female end 25' of member 22 has a semicylindrical portion of the same diameter and fits slidably into barrel 19. Upon depression of the trigger 10 as shown in FIG. 7, member 23 is rotated through nearly 90° while the plunger 20 linked with the member 22 is advanced in barrel 19 whereby its stem 15 enters the slot 7' of needle 7 to eject the locking bar 4 (FIGS. 1–3) inserted therein.

In FIGS. 7A and 7B I have shown two further needles *7a* and *7b*, differing in length from needle 7, which can be substituted for the latter if a heavier fabric is to be penetrated. For this purpose it is merely necessary to rotate the locking pin 14 until a flat face thereof (not shown) confronts the needle shank 7'' and facilitates the withdrawal. It will be noted that all three needles 7, *7a* , and *7b* have shanks 7'' of the same size.

If the plunger 20 needs replacement, it is merely necessary to remove the screw 12'' and to pull off the lid 12 and the block 13 by their knobs 12' and 13'. With trigger 10 released, as seen in FIG. 6, plunger 20 is largely exposed and its stem 15 can be easily gripped to extract its head 16 from the bore 25 of link member 22. Another plunger, or possibly the same one after inspection or repair, can then be inserted whereupon members 12 and 13 are restored to reclose the barrel 19.

The compression spring 30, 32–34 can also be quickly removed from the gun body 9 after inspection, repair or replacement, if necessary.

I claim:

1. In a gun for the attachment of bar-lock tags to a penetrable article, comprising a body with a front end engaging a longitudinally slotted forwardly projecting needle, a barrel extending rearward from said front end, a plunger guided in said barrel in line with said needle, a trigger pivoted to said body for manual displacement between an idle position and a working position, and coupling means connecting said trigger with said plunger for advancing a tip of the latter in the slot of said needle upon movement into said working position for ejecting a bar-lock tag previously inserted into said slot, the improvement wherein said barrel is open to one side and said plunger is laterally detachable from said coupling means, said body being provided with detachable cover means normally overlying said barrel at said one side, removal of said cover means enabling a lateral extraction of said plunger from said barrel in the idle position of said trigger, said body being further provided with retaining means keeping said needle removably seated in said front end.

2. A tag-attaching gun as defined in claim 1 wherein said plunger has a stem fitting into said slot and a head at the rear of said stem removably engaged by said coupling means, said cover means including a block with a stem-guiding groove extending laterally into said barrel.

3. A tag-attaching gun as defined in claim 2 wherein said cover means further includes a lid adjoining said block in a region of displacement of said head.

4. A tag-attaching gun as defined in claim 1, 2 or 3 wherein said body is formed with an arcuate channel tangentially merging into the rear end of said barrel, said coupling means comprising an articulated linkage with a plurality of members occupying said channel in said idle position.

5. A tag-attaching gun as defined in claim 4 wherein said channel extends over an arc of substantially 90°.

6. A tag-attaching gun as defined in claim 4 wherein said linkage includes a front member engaging said plunger, a rear member fulcrumed on said body at the center of curvature of said channel, and at least one intermediate member articulated to both said front and rear members, said rear member being linked with said trigger.

7. A tag-attaching gun as defined in claim 6 wherein said rear member, said intermediate member and said front member each have a female end accommodating a male end of said intermediate member, said front member and said plunger, respectively, said female ends slidably fitting into said channel and said barrel.

8. A tag-attaching gun as defined in claim 6, further comprising spring means anchored to said body and said linkage for biasing said trigger into said idle position.

9. A tag-attaching gun as defined in claim 8 wherein said spring means comprises a compression spring including two telescoped elements with extremities respectively pivoted to said body and to said rear member.

10. A tag-attaching gun as defined in claim 9 wherein said extremities are bifurcate for facilitating a disengagement of said spring from said body and said rear member.

* * * * *